US008022751B2

(12) United States Patent
Le et al.

(10) Patent No.: US 8,022,751 B2
(45) Date of Patent: Sep. 20, 2011

(54) SYSTEMS AND METHODS FOR TRIMMING BANDGAP OFFSET WITH BIPOLAR ELEMENTS

(75) Inventors: Minh Le, Gilbert, AZ (US); Woowai Martin, Phoenix, AZ (US)

(73) Assignee: Microchip Technology Incorporated, Chandler, AZ (US)

( * ) Notice: Subject to any disclaimer, the term of this patent is extended or adjusted under 35 U.S.C. 154(b) by 0 days.

(21) Appl. No.: 12/613,284

(22) Filed: Nov. 5, 2009

(65) Prior Publication Data

US 2010/0123514 A1 May 20, 2010

Related U.S. Application Data

(60) Provisional application No. 61/115,631, filed on Nov. 18, 2008.

(51) Int. Cl.
*G05F 1/10* (2006.01)

(52) U.S. Cl. ..... 327/539; 323/313

(58) Field of Classification Search ..... 327/513, 327/539; 323/313
See application file for complete search history.

(56) References Cited

U.S. PATENT DOCUMENTS

| | | | | |
|---|---|---|---|---|
| 5,325,045 | A * | 6/1994 | Sundby | 323/313 |
| 6,018,272 | A * | 1/2000 | Marsh et al. | 330/307 |
| 6,163,199 | A * | 12/2000 | Miske et al. | 327/434 |
| 6,590,372 | B1 * | 7/2003 | Wiles, Jr. | 323/316 |
| 6,608,472 | B1 | 8/2003 | Kutz et al. | 323/313 |
| 6,870,421 | B2 * | 3/2005 | Abe | 327/539 |
| 6,894,473 | B1 * | 5/2005 | Le et al. | 323/314 |
| 7,119,414 | B2 * | 10/2006 | Hisaka | 257/529 |
| 7,151,414 | B2 * | 12/2006 | Molina et al. | 331/17 |
| 7,443,226 | B1 * | 10/2008 | Holloway et al. | 327/513 |
| 7,463,012 | B2 * | 12/2008 | Mottola | 323/313 |
| 7,538,597 | B2 * | 5/2009 | Kwong et al. | 327/525 |
| 7,880,459 | B2 * | 2/2011 | Harvey | 323/313 |
| 2006/0164158 | A1 * | 7/2006 | Kimura | 327/539 |
| 2006/0285414 | A1 | 12/2006 | Kimura | 365/225.7 |
| 2007/0098041 | A1 | 5/2007 | Seo | 374/170 |
| 2008/0084240 | A1 * | 4/2008 | Passerini et al. | 327/539 |

FOREIGN PATENT DOCUMENTS

JP 2001217393 8/2001

OTHER PUBLICATIONS

International PCT Search Report, PCT/US2009/064756, 14 pages, mailed Mar. 11, 2010.

* cited by examiner

*Primary Examiner* — Thomas J. Hiltunen
(74) *Attorney, Agent, or Firm* — King & Spalding L.L.P.

(57) ABSTRACT

An integrated circuit has an untrimmed bandgap generation circuit; and a bandgap generation circuit coupled to the untrimmed bandgap generation circuit. The bandgap generation circuit has a current source controlled by the untrimmed bandgap generation circuit and coupled in series with a resistor and a first bipolar diode device, one or more of bipolar diode devices, each bipolar diode device coupled in parallel with the first bipolar diode device, wherein a trimmed bandgap reference voltage output of the integrated circuit is a function of the number of bipolar diode devices.

22 Claims, 5 Drawing Sheets

SYSTEMS AND METHODS FOR TRIMMING BANDGAP OFFSET WITH BIPOLAR ELEMENTS

CROSS-REFERENCE TO RELATED APPLICATIONS

This application claims the benefit of U.S. Provisional Application No. 61/115,631 filed on Nov. 18, 2008, entitled "SYSTEMS AND METHODS FOR TRIMMING BANDGAP OFFSET WITH BIPOLAR DIODE ELEMENTS", which is incorporated herein in its entirety.

TECHNICAL FIELD

The technical field of the present application relates to circuits, and more particularly, to trimming bandgap offsets with diode elements.

BACKGROUND

In analog circuit design, it may be difficult to obtain precise voltages or measurements because analog components have many parameters that vary with process, temperature, and/or or power supplied. Therefore, one or more reference voltages for an integrated circuit may be generated from a bandgap reference voltage circuit. If, however, the bandgap reference voltage is not accurate due to variations in the power supplied or temperature, then all reference voltages derived from the bandgap reference voltage will also be inaccurate. This could induce substantial errors in the operation of the integrated circuit.

Accurate resistor values are also important in analog circuits for achieving precise current values. For example, if resistor values in A/D converters are inaccurate, then the voltage range associated with each of the bits of the A/D converter may be in error.

Current techniques for achieving more precise resistor values includes the use of lasers to trim a resistor after fabrication, in order to obtain a precise value for that resistor. For example, a film resistor may be fabricated with a lower resistance value than desired whereby a laser beam can be used to remove a portion of the film of the resistor thereby increasing its resistance and effectively "trimming" the resistor to precisely the desired value. However, such trimmed resistors may drift after trimming and such drifting can be accelerated by thermocycling.

Another technique for trimming element values in an integrated circuit by the use of multiple fusible link elements. However, such a technique consumes substantial area on the integrated circuit, and requires additional external pins.

SUMMARY

According to an embodiment, an integrated circuit may comprise an untrimmed bandgap generation circuit; and a bandgap generation circuit coupled to the untrimmed bandgap generation circuit, the bandgap generation circuit comprising: a current source controlled by the untrimmed bandgap generation circuit and coupled in series with a resistor and a first bipolar diode device; one or more of bipolar diode devices, each bipolar diode device coupled in parallel with the first bipolar diode device, wherein a trimmed bandgap reference voltage output of the integrated circuit is a function of the number of bipolar diode devices.

According to a further embodiment, the one or more bipolar diode devices may comprise a bipolar junction transistor.

According to a further embodiment, the current source can be a metal oxide semiconductor field effect transistor (MOSFET). According to a further embodiment, the one or more bipolar diode devices may be coupled in parallel with the first bipolar diode through respective metal oxide semiconductor field effect transistors (MOSFET) coupled in series with each bipolar diode device. According to a further embodiment, the one or more bipolar diode devices may be at least two bipolar diode device which are dimensioned differently. According to a further embodiment, at least one bipolar diode devices may be coupled in parallel with the first bipolar diode through a fuse coupled in series with the at least one bipolar diode device. According to a further embodiment, the integrated circuit may further comprise a control unit for controlling the metal oxide semiconductor field effect transistors (MOSFET) coupled in series with each bipolar diode device. According to a further embodiment, the control unit may comprise non-volatile memory. According to a further embodiment, the resistor can be formed by at least two resistors coupled in series. According to a further embodiment, the untrimmed bandgap generation circuit may comprise a first and second branch each having a current source, a resistor and a bipolar diode device coupled in series, and a differential amplifier coupled with the first and second branch and having an output controlling the current sources. According to a further embodiment, the first branch may comprise a series of two resistors and the node between the two resistors is coupled with the differential amplifier, and wherein the second branch is connected to the differential amplifier at a node between the resistor and the bipolar diode device. According to a further embodiment, each bipolar diode device of the untrimmed bandgap generation circuit may comprise a bipolar junction transistor. According to a further embodiment, each current source of the untrimmed bandgap generation circuit may be a metal oxide semiconductor field effect transistor (MOSFET).

According to another embodiment, a system for trimming a bandgap output may comprise an untrimmed bandgap generation circuit; a bandgap generation circuit coupled to the untrimmed bandgap generation circuit, the bandgap generation circuit comprising: a current source controlled by the untrimmed bandgap generation circuit and coupled in series with a resistor and a first bipolar diode device, and one or more of bipolar diode devices, each bipolar diode coupled in series with a switch wherein the series of bipolar diode device and switch is coupled in parallel with the first bipolar diode; and a processor providing control signals for the switches, wherein a trimmed bandgap output of the integrated circuit is a function of the number of bipolar diode devices coupled in parallel through the switches.

According to a further embodiment, the one or more bipolar diode devices may comprise a bipolar junction transistor. According to a further embodiment, the current source may be a metal oxide semiconductor field effect transistor (MOSFET). According to a further embodiment, the switches can be metal oxide semiconductor field effect transistors (MOSFET). According to a further embodiment, the system may further comprise a control unit for controlling the switches. According to a further embodiment, the control unit may comprise non-volatile memory. According to a further embodiment, the resistor can be formed by at least two resistors coupled in series.

According to yet another embodiment, a method for trimming a bandgap reference voltage may comprise the steps of: generating an untrimmed bandgap voltage by a bandgap circuit having an internal feedback signal; providing at least one trimmable bandgap branch comprising: a current source coupled in series with a resistor and a first bipolar diode device, and one or more of bipolar diode devices, each bipolar diode coupled in series with a switch wherein the series of bipolar diode device and switch is coupled in parallel with the first bipolar diode; controlling the current source by the internal feedback signal, and controlling the switches wherein a trimmed bandgap output of the trimmable bandgap branch is a function of the number of bipolar diode devices coupled in parallel through the switches. According to a further embodiment, the switches can be controlled directly by a processor. According to a further embodiment, the switches can be controlled through a selection circuit. According to a further embodiment, at least one switch may be a fuse and further comprising the step of setting the fuse.

BRIEF DESCRIPTION OF THE DRAWINGS

A more complete understanding of the present embodiments and advantages thereof may be acquired by referring to the following description taken in conjunction with the accompanying drawings, in which like reference numbers indicate like features, and wherein.

DETAILED DESCRIPTION

According to an embodiment, an integrated circuit may comprise an untrimmed bandgap generation circuit; and a bandgap generation circuit coupled to the untrimmed bandgap generation circuit, the bandgap generation circuit comprising: one or more of bipolar diode devices, each bipolar diode device coupled in parallel with another bipolar diode device, and wherein a trimmed bandgap output of the integrated circuit is a function of the number of bipolar diode devices.

According to a further embodiment, the one or more bipolar diode devices may comprise a bipolar junction transistor. According to a further embodiment, the one or more bipolar diode devices may comprise a bipolar junction transistor (BJT) coupled in series with a metal oxide semiconductor field effect transistor (MOSFET). According to a further embodiment, the one or more bipolar diode devices can be coupled in series to one or more resistors.

According to another embodiment, a system for trimming bandgap output, the system may comprise an untrimmed bandgap generation circuit; and a bandgap generation circuit coupled to the untrimmed bandgap generation circuit, the bandgap generation circuit comprising: one or more of bipolar diode devices, each bipolar diode device coupled in parallel with another bipolar diode device, and wherein a trimmed bandgap output of the integrated circuit is a function of the number of bipolar diode devices.

Preferred embodiments and their advantages are best understood by reference to FIGS. 1 through 5 wherein like numbers are used to indicate like and corresponding parts.

Figure 1:
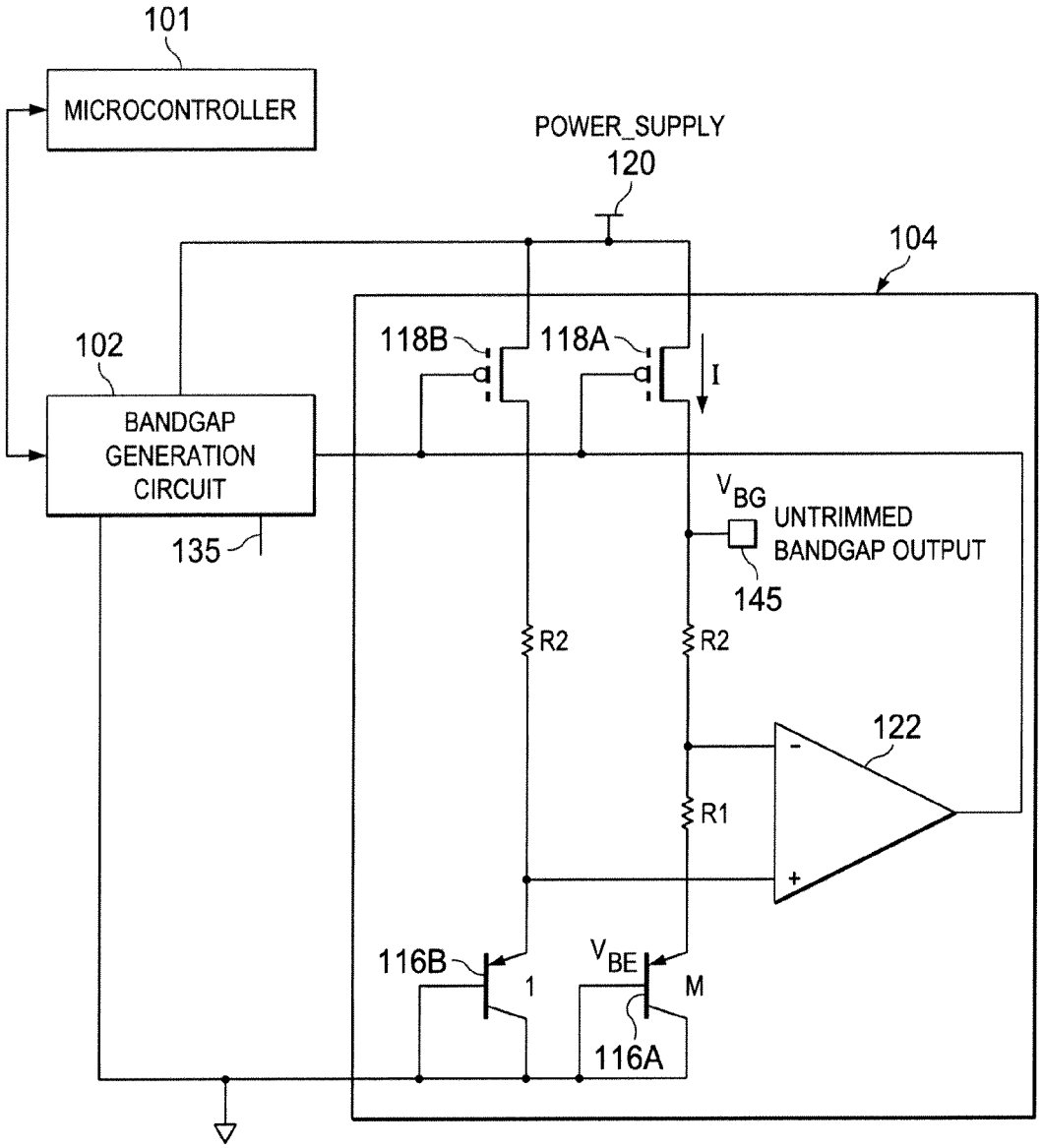
FIG. 1 illustrates an example bandgap generation circuit coupled to a untrimmed bandgap generation circuit, in accordance with certain embodiment of the present disclosure.
Figure 2:
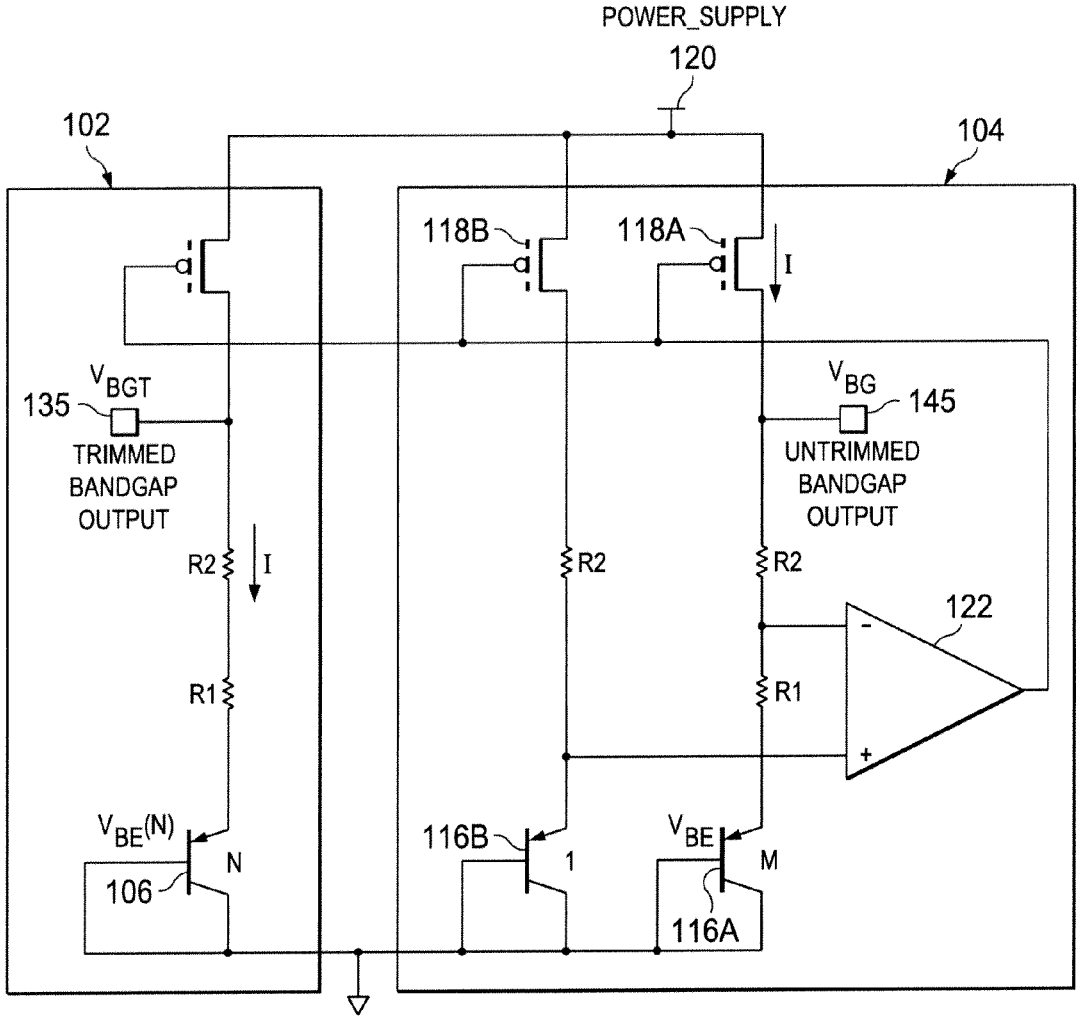
FIG. 2 illustrates an example bandgap generation circuit, in accordance with certain embodiment of the present disclosure.

FIG. 1 illustrates an example bandgap generation circuit 102 which can be controlled by a microcontroller 101 or any other type of microprocessor or controller and which is coupled to an untrimmed bandgap generation circuit 104. Trimmed bandgap generation circuit 102 is configurable, for example, through microcontroller 101 or any other processor or controller, to provide a large trim range (e.g., 100 mV), small curvature variations, low current for low power applications (e.g., 1 μA), in accordance with certain embodiment of the present disclosure. Untrimmed bandgap generation circuit 104 may include a plurality of bipolar junction transistors (BJTs) 116 coupled in series to one or more resistors (R1, R2). In the embodiment shown in FIG. 2, a first branch includes metal oxide semiconductor field effect transistor (MOSFET) 118A for providing current I. The first branch further includes series coupled resistors R1 and R2 coupled with BJT 116A on one hand and with the MOSFET 118A on the other hand which is coupled in series with a power supply 120. The second branch consists of series coupled MOSFET 118B, resistor R2, and BJT 116B. MOSFET transistors 118 A and B are controlled to provide the current I for each branch of the bandgap generation circuit 104. Untrimmed bandgap generation circuit 104 may also include buffer 122 that controls MOSFET transistors 118 in a feedback loop. The same control signal is also fed to bandgap generation circuit 102. An output of the untrimmed bandgap generation circuit can be obtained at the node 145 between transistor 118A and resistor R2. The principle of the circuit is to generate a second voltage to the forward voltage of diode connected transistor 116A that has an negative temperature coefficient. For example, transistor 116A may have a temperature coefficient of −2 mV/K at 0.6 V. The circuit 104 can be dimensioned such that the voltage over resistors R1 and R2 will have a temperature coefficient of +2 mV/K. Hence, the bandgap output voltage will be nearly temperature independent. It is noted that although untrimmed bandgap generation circuit 104 may include certain circuit elements, other configurations may also be used.

As shown in FIG. 1, this untrimmed bandgap reference circuit 104 can be combined with bandgap generation circuit 102 to also provide for a trimmed bandgap reference voltage output 135. In one embodiment, this additional trimmable bandgap generation circuit 102 may include one or more bipolar diode elements. For example, referring to FIG. 2, an example bandgap generation circuit 102 is shown. Bandgap generation circuit 102 may include bipolar diode 106 coupled in series with a first resistor 1 (R1) and a second resistor (R2). The output 135 provides for an additional trimmed bandgap output voltage as will be explained below. To obtain a constant reference voltage, this circuit provides for an additional branch for circuit 104 which uses the principles as explained above. A detailed explanation follows below. The untrimmed bandgap output voltage-current equation at the untrimmed bandgap generation circuit 104 is:

$$V_{BG}=I^{*}(R1+R2)+V_{BE} \qquad \text{Eq. 1}$$

where $V_{BG}$ is the untrimmed bandgap output, I is the current, R1 and R2 is the resistor value for the resistors in the untrimmed bandgap generation circuit 104, and $V_{BE}$ is base-emitter voltage. The trimmed bandgap output voltage-current equation at the bandgap generation circuit 102 is:

$$V_{BGT}=I^{*}(R1+R2)+V_{BE}(N) \qquad \text{Eq. 2}$$

where $V_{BGT}$ is the trimmed bandgap output, I is the current, R1 and R2 is the resistor value for the resistors in the bandgap generation circuit 102, $V_{BE}$ is base-emitter voltage, and N is the number of bipolar diodes used in the trimming process. From Eq. 2, the trimmed bandgap output voltage-current can be adjusted based on the number of bipolar diodes (N) used, while keeping $V_{BGT}$ constant as a function of T (Temperature), as shown below with respect to Eq. 3.

From a diode expression $$I=I_s*\exp(V_{BE}/V_T) \quad \text{Eq. 3}$$

where $V_{BE}$ is base-emitter voltage, $I_s$ is a constant value, and $V_T$=kT/q (k is Boltzmann const, q is the electron charge, and T is temperature in Kelvin), $$V_{BE}=V_T*\ln(I/I_S) \quad \text{Eq. 4}$$

where ln is natural logarithm function and $$V_{BE}(N)=V_T*\ln[I/(N*I_s)] \quad \text{Eq. 5.}$$

Substituting Eq. 4 into Eq. 1, $$V_{BG}=I*(R1+R2)+V_T*\ln(I/I_S) \quad \text{Eq. 6}$$

Substituting Eq. 5 into Eq. 2 yields $$V_{BGT}=I*(R1+R2)+V_T*\ln[I/(N*I_s)] \quad \text{Eq. 7}$$

Given that ln(a/b)=ln(a)−ln(b) and ln(a*b)=ln(a)+ln(b) Eq. 7 may be simplified to $$V_{BGT}=I*(R1+R2)+V_T*(\ln(I)-\ln(N*I_s))=I*(R1+R2)+V_T*\{\ln(I)-\ln(N)-\ln(I_s)\} \quad \text{Eq. 8}$$

or $$V_{BGT}=I*(R1+R2)+V_T*(\ln(I)-\ln(Is))-V_T*\ln(N)=I*(R1+R2)+VT*\ln(I/I_s)-V_T*\ln(N) \quad \text{Eq. 9}$$

Replacing the first two expression from Eq. 9 which equals Eq. 6, $$V_{BGT}=V_{BG}-V_T*\ln(N) \quad \text{Eq. 10}$$

If Eq. 10 is differentiated on both sides of the equation and with respect to T (temperature)

$$d/dT(V_{BGT})=d/dT(V_{BG})-d/dT(V_T)=d/dT(V_{BG})-(k/q)*\ln N \quad \text{Eq. 11}$$

where $V_T$=kT/q. k/q*ln N may be a very small number thus $$d/dT(V_{BGT}) \text{ is substantially equal to } d/dT(V_{BG}) \quad \text{Eq. 12.}$$

Eq. 12 shows that the rate of change of trimmed bandgap voltage over temperature is approximately the same as the rate of change of the untrimmed bandgap voltage over temperature.

Figure 3:
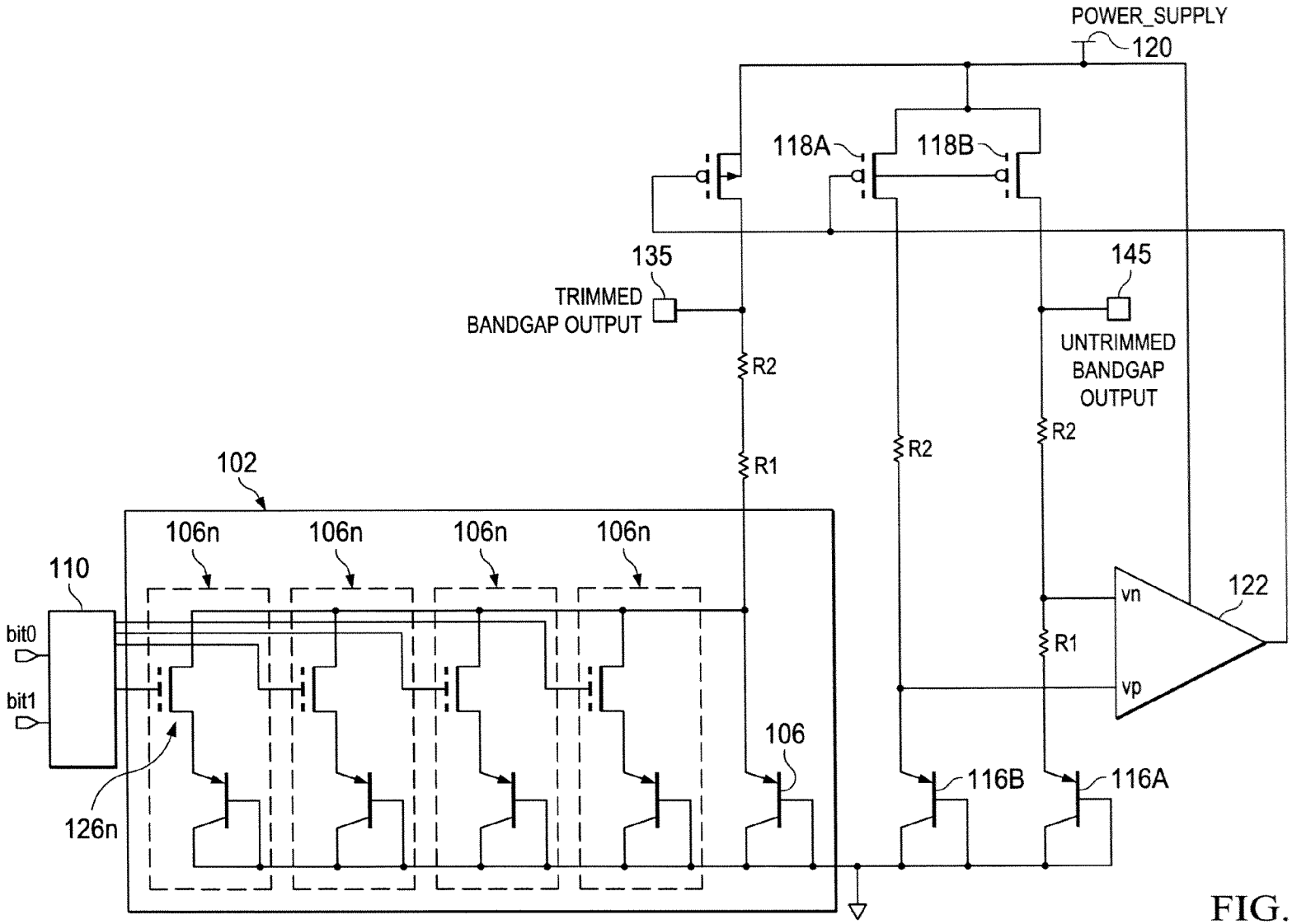
FIG. 3 illustrates an example of a bandgap generation circuit with multiple bipolar diodes, in accordance with certain embodiment of the present disclosure.

As noted above, from Eq. 2, the trimmed bandgap output voltage-current may be a function of the number of bipolar diodes (N) used in bandgap generation circuit 102. Referring to FIG. 3, this embodiment of bandgap generation circuit 102 may include one or multiple further bipolar diodes **106*n* which can be coupled in parallel to transistor 106. To this end, a digitally controllable selection circuit 110 may be provided to connect each additional transistor 106*n* in parallel with transistor 106. In one embodiment, each additional set may include a metal oxide semiconductor field effect transistor (MOSFET) 126*n* coupled in series with a bipolar junction transistor (BJT) 115 (e.g., PNP transistor or a NPN transistor) 106*n*, wherein each set consisting of bipolar diode 106*n* and MOSFET 126*n* may be coupled in parallel with another set and with BJT 106. While four sets of the MOSFET-BJT trimming branches are shown in FIG. 3, any number of bipolar diodes 106/106*n* may be used to trim the bandgap offset. Selection circuit 110 can be controlled by a microcontroller (not shown) to adjust the reference 120 output voltage of the bandgap reference circuit 102 and may contain non-volatile memory. Thus, depending on a digital input signal at selection circuit 110, 0, 1, 2, 3, or 4 transistors 106*n* will be coupled in parallel to transistor 106 thereby providing different reference output voltages at output 135**.

Figure 4:
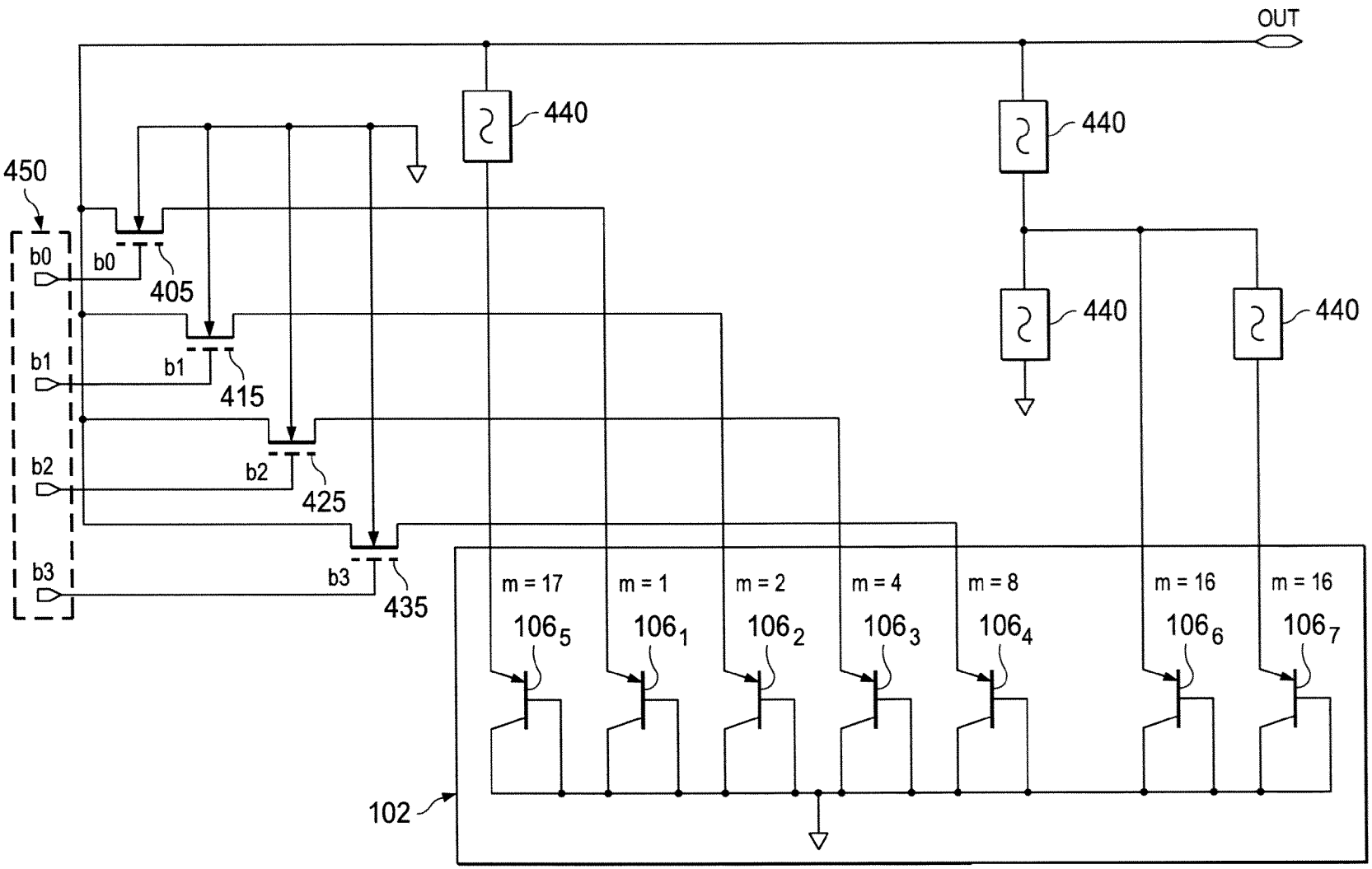
FIG. 4 illustrates another example of relevant portions of a trimmable bandgap generation circuit with multiple bipolar diodes, in accordance with certain embodiment of the present disclosure.

In yet another embodiment, the selection circuit 110 may simply consist of respective drivers, registers, or direct connections which pass the digital signal, for example a 4-bit signal, to transistors **126*n*. Thus, if differently dimensioned transistors 106*n* are provided, up to $2^n$ different reference output voltages could be provided. FIG. 4 shows a further embodiment of the relevant parts of a circuit 102 which can achieve such a variety. Here each transistor $\mathbf{106}_1$, $\mathbf{106}_2$, $\mathbf{106}_3$, and $\mathbf{106}_4$ are dimensioned to each other by a factor of 2 resulting, for example in different on-resistance transistor properties of 1, 2, 4, and 8. This can be done, for example, by implementing each transistor by coupling 1, 2, 4, or 8 transistors in parallel, respectively. In other words, transistor $\mathbf{106}_1$ is implemented as a single transistor. Transistor $\mathbf{106}_2$ is implemented as two transistors 135** coupled in parallel. Transistor $\mathbf{106}_3$ is implemented as four transistors coupled in parallel and transistor $\mathbf{106}_4$ is implemented as eight transistors coupled in parallel. However, according to other embodiments, the on-resistance can be adjusted by other means as well known in the art.

Transistors 405, 415, 425, and 435 programmably connect each additional 140 transistor $\mathbf{106}_1$, $\mathbf{106}_2$, $\mathbf{106}_3$, and $\mathbf{106}_4$ to the output of circuit 102 which is coupled with transistor 106 as shown in FIG. 3. In addition, one or more further transistor $\mathbf{106}_5$, $\mathbf{106}_6$, and $\mathbf{106}_7$ can be added optionally by fuses 440. Depending on the configuration these transistors $\mathbf{106}_5$, $\mathbf{106}_6$, and $\mathbf{106}_7$ can provide for extended reference voltage ranges. These transistors $\mathbf{106}_5$, $\mathbf{106}_6$, and $\mathbf{106}_7$ may be differently dimensioned such as transistor $\mathbf{106}_5$ may consist of m=17 parallel coupled transistors and transistors $\mathbf{106}_6$ and $\mathbf{106}_7$ may consist of m=16 parallel coupled transistors as explained above. Other dimensioning parameters may be used depending on the specific requirements. Thus, the used values in all figures are mere examples of one specific embodiment. Fuses 440 may be set during manufacture and could be one-time programmed by a user. In other embodiments, fuses 440 can be replaced by programmable transistors such as transistors 405, 415, 425, or 435. However, more programmable transistors may require more programming signal lines 450.

Figure 5:
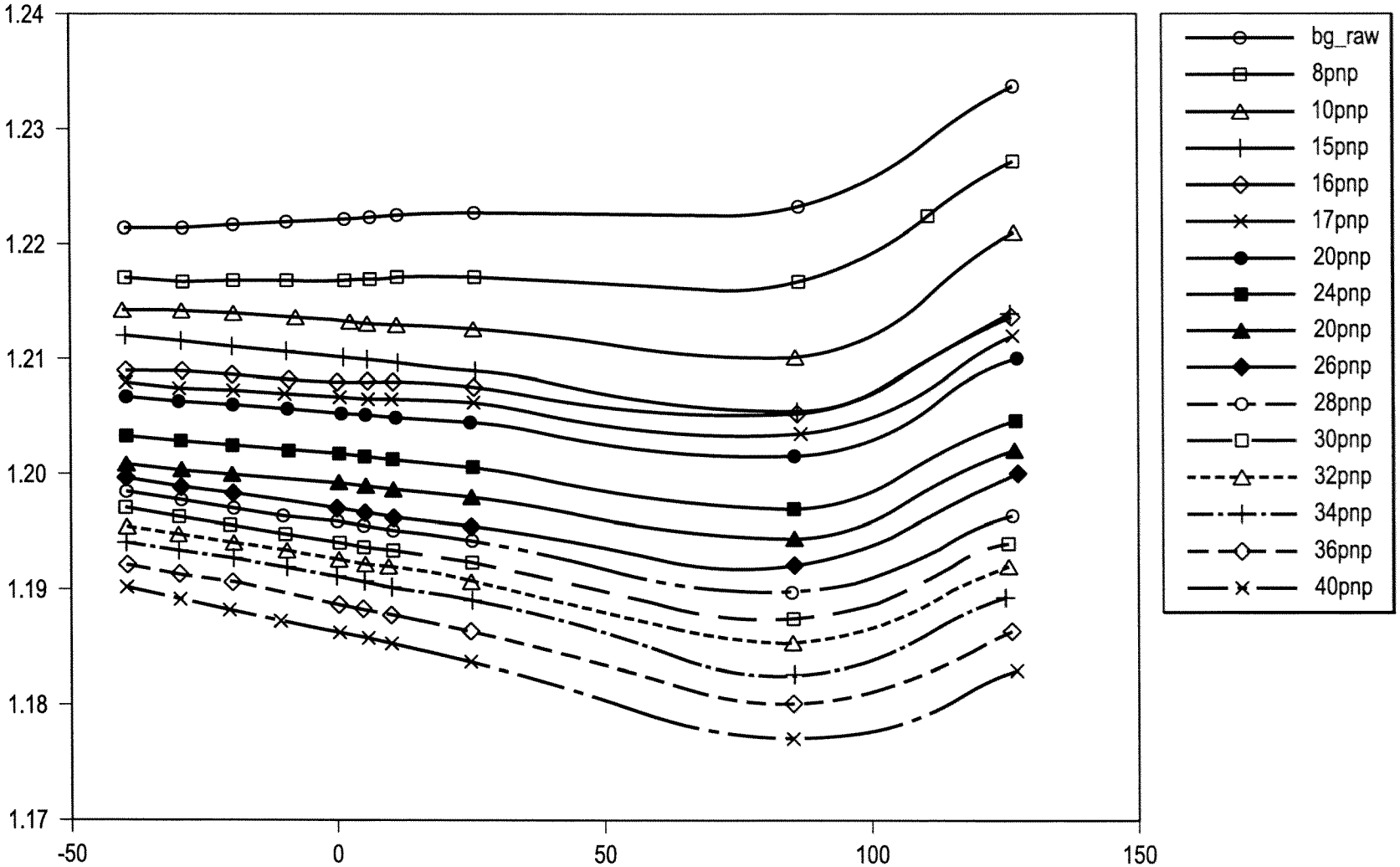
FIG. 5 illustrates a graph showing output reference voltage generated by a bandgap generation circuit according to various embodiments.

FIG. 5 shows the variety of trimmable output voltages depending on the temperature. The x-axis designates a temperature range from −50 to 150° C. and the y-axis designates the various bandgap output voltages at output 135 and 145. The different symbols designating the different curves refer to different programming words. FIG. 5 shows different numbers "xpnp" which refer to the combined factor m of in this case activated PNP transistors $\mathbf{106}_1$, $\mathbf{106}_2$, $\mathbf{106}_3$, $\mathbf{106}_4$, $\mathbf{106}_5$, $\mathbf{106}_6$, and $\mathbf{106}_7$. With the embodiment shown in FIG. 4, only some sets of these curves are available depending on the setting of the fuses. For example, if only transistors $\mathbf{106}_1$, $\mathbf{106}_2$, $\mathbf{106}_3$, and $\mathbf{106}_4$ are available, then 0 pnp-15 pnp with increments of 1 pnp would be available. Curve bg_raw designates the untrimmed output voltage at 145.

While embodiments of this disclosure have been depicted, described, and are defined by reference to example embodiments of the disclosure, such references do not imply a limitation on the disclosure, and no such limitation is to be inferred. The subject matter disclosed is capable of considerable modification, alteration, and equivalents in form and function, as will occur to those ordinarily skilled in the pertinent art and having the benefit of this disclosure.

What is claimed is:

1. An integrated circuit, comprising:

an untrimmed bandgap generation circuit; and a bandgap generation circuit coupled to the untrimmed bandgap generation circuit, the bandgap generation circuit comprising:

a current source controlled by said untrimmed bandgap generation circuit and coupled in series with a resistor and a first bipolar diode device, one or more of bipolar diode devices, each bipolar diode device coupled in series with a switch wherein each bipolar diode device and switch coupled in series is coupled in parallel with said first bipolar diode device, wherein a trimmed bandgap reference voltage output of the integrated circuit is a function of the number of parallel switched bipolar diode devices, and wherein at least one additional bipolar diode devices is coupled in parallel with said first bipolar diode through a fuse coupled in series with said at least one additional bipolar diode device.

2. The integrated circuit according to claim 1, wherein the one or more bipolar diode devices comprise a bipolar junction transistor.

3. The integrated circuit according to claim 1, wherein the current source is a metal oxide semiconductor field effect transistor (MOSFET).

4. The integrated circuit according to claim 1, wherein the one or more bipolar diode devices are coupled in parallel with said first bipolar diode through respective metal oxide semiconductor field effect transistors (MOSFET).

5. The integrated circuit according to claim 4, wherein the one or more bipolar diode devices are at least two bipolar diode device which are dimensioned differently.

6. The integrated circuit according to claim 4, further comprising a control unit for controlling said metal oxide semiconductor field effect transistors (MOSFET) coupled in series with each bipolar diode device.

7. The integrated circuit according to claim 6, wherein the control unit comprises non-volatile memory.

8. The integrated circuit according to claim 4, wherein the resistor is formed by at least two resistors coupled in series.

9. The integrated circuit according to claim 1, wherein the untrimmed bandgap generation circuit comprises a first and second branch each having a current source, a resistor and a bipolar diode device coupled in series, and a differential amplifier coupled with said first and second branch and having an output controlling said current sources.

10. The integrated circuit according to claim 9, wherein the first branch comprises a series of two resistors and the node between the two resistors is coupled with said differential amplifier, and wherein the second branch is connected to said differential amplifier at a node between said resistor and said bipolar diode device.

11. The integrated circuit according to claim 9, wherein each bipolar diode device of the untrimmed bandgap generation circuit comprise a bipolar junction transistor.

12. The integrated circuit according to claim 9, wherein each current source of the untrimmed bandgap generation circuit is a metal oxide semiconductor field effect transistor (MOSFET).

13. A system for trimming bandgap output, the system comprising:

an untrimmed bandgap generation circuit;

a bandgap generation circuit coupled to the untrimmed bandgap generation circuit, the bandgap generation circuit comprising:

a current source controlled by said untrimmed bandgap generation circuit and coupled in series with a resistor and a first bipolar diode device, one or more of bipolar diode devices, each bipolar diode coupled in series with a switch wherein each bipolar diode device and switch coupled in series is coupled in parallel with said first bipolar diode, wherein at least one additional bipolar diode devices is coupled in parallel with said first bipolar diode through a fuse coupled in series with said at least one additional bipolar diode device; and a processor providing control signals for said switches, wherein a trimmed bandgap output of the integrated circuit is a function of the number of bipolar diode devices coupled in parallel through said switches.

14. The system according to claim 13, wherein the one or more bipolar diode devices comprise a bipolar junction transistor.

15. The system according to claim 13, wherein the current source is a metal oxide semiconductor field effect transistor (MOSFET).

16. The system according to claim 13, wherein the switches are metal oxide semiconductor field effect transistors (MOSFET).

17. The system according to claim 13, further comprising a control unit for controlling said switches.

18. The system according to claim 17, wherein the control unit comprises non-volatile memory.

19. The system according to claim 13, wherein the resistor is formed by at least two resistors coupled in series.

20. A method for trimming a bandgap reference voltage, the method comprising the steps of:

Generating an untrimmed bandgap voltage by a bandgap circuit having an internal feedback signal;

Providing at least one trimmable bandgap branch comprising:

a current source coupled in series with a resistor and a first bipolar diode device, and one or more of bipolar diode devices, each bipolar diode coupled in series with a switch wherein each bipolar diode device and switch coupled in series is coupled in parallel with said first bipolar diode, wherein at least one switch is a fuse;

Setting said fuse;

Controlling said current source by said internal feedback signal;

and

Controlling said switches wherein a trimmed bandgap output of the trimmable bandgap branch is a function of the number of bipolar diode devices coupled in parallel through said switches.

21. The method according to claim 20, wherein said switches are controlled directly by a processor.

22. The method according to claim 20, wherein said switches are controlled through a selection circuit.

* * * * *